US010130555B2

(12) United States Patent
Song

(10) Patent No.: US 10,130,555 B2
(45) Date of Patent: Nov. 20, 2018

(54) FOOT MASSAGE PHYSIOTHERAPY PLATES

(71) Applicant: Jiqian Li, Lishui (CN)

(72) Inventor: Chuanshu Song, Lishui (CN)

(73) Assignee: Jiqian Li, Lishui (CN)

( * ) Notice: Subject to any disclaimer, the term of this patent is extended or adjusted under 35 U.S.C. 154(b) by 672 days.

(21) Appl. No.: 14/846,832

(22) Filed: Sep. 7, 2015

(65) Prior Publication Data

US 2017/0042765 A1 Feb. 16, 2017

(30) Foreign Application Priority Data

Aug. 13, 2015 (CN) ..... 2015 2 0606347 U

(51) Int. Cl.
*A61H 39/04* (2006.01)
*A43B 7/14* (2006.01)

(52) U.S. Cl.
CPC ..... *A61H 39/04* (2013.01); *A43B 7/1445* (2013.01); *A61H 2201/1207* (2013.01); *A61H 2201/165* (2013.01); *A61H 2205/125* (2013.01)

(58) Field of Classification Search
CPC ..... A61H 39/04; A61H 2205/12–2205/125; A43B 7/1415–7/145
See application file for complete search history.

(56) References Cited

U.S. PATENT DOCUMENTS 4,727,661 A * 3/1988 Kuhn ..... A43B 1/0054 36/100
4,841,647 A * 6/1989 Turucz ..... A43B 7/1415 36/43
5,551,173 A * 9/1996 Chambers ..... A43B 7/146 36/141
5,768,803 A * 6/1998 Levy ..... A43B 7/1425 36/140
5,860,229 A * 1/1999 Morgenstern ..... A43B 7/1415 36/141
6,434,859 B1 * 8/2002 Kim ..... A43B 7/142 36/43
6,715,221 B1 * 4/2004 Sasaki ..... A43B 1/0045 36/141
6,742,289 B2 * 6/2004 Celmo ..... A43B 7/1465 36/141

(Continued)

*Primary Examiner* — Jennifer M Deichl
(74) *Attorney, Agent, or Firm* — Gokalp Bayramoglu

(57) ABSTRACT

This disclosure discloses a pair of foot massage physiotherapy plates. The foot massage physiotherapy plates comprise bottom plates, foot reflex zone massage blocks and foot acupuncture point massage posts; the foot reflex zone massage blocks are connected with the bottom plates through massage block bolts and the foot acupuncture point massage posts are connected with the foot reflex zone massage blocks through massage post bolts; massage bulges are arranged on the front surfaces of the foot reflex zone massage blocks. The foot massage physiotherapy plates disclosed by the disclosure change the design of fixed massage blocks for only massaging foot reflex zones, and the detachably installed foot acupuncture point massage posts are arranged on the detachably installed foot reflex zone massage blocks; the foot massage physiotherapy plates disclosed by the disclosure are safe, reliable, convenient, effective, comfortable and health-promoting.

8 Claims, 8 Drawing Sheets

(56) References Cited

U.S. PATENT DOCUMENTS

| | | | | |
|---|---|---|---|---|
| 7,264,599 | B1 * | 9/2007 | Milligan | A43B 3/0005 36/141 |
| 7,644,522 | B2 * | 1/2010 | Ramirez | A43B 7/1415 36/155 |
| 8,615,905 | B1 * | 12/2013 | Szabo | A43B 1/0081 36/11.5 |
| D734,011 | S * | 7/2015 | Lu | D2/961 |
| 9,820,911 | B2 * | 11/2017 | Shoshani | A61H 39/04 |
| 2002/0049469 | A1 * | 4/2002 | Chang | A43B 7/146 606/204 |
| 2004/0111924 | A1 * | 6/2004 | Riccardi | A43B 7/146 36/141 |
| 2005/0049533 | A1 * | 3/2005 | Beiruti | A43B 7/142 601/118 |
| 2008/0010868 | A1 * | 1/2008 | Tsai | A43B 1/0081 36/141 |
| 2009/0188129 | A1 * | 7/2009 | Fusco | A43B 7/142 36/44 |
| 2010/0058540 | A1 * | 3/2010 | Calvert | A43B 1/0081 5/652 |
| 2012/0030969 | A1 * | 2/2012 | Lim | A43B 1/0054 36/141 |
| 2016/0000177 | A1 * | 1/2016 | Barkol | A43B 7/146 2/239 |
| 2016/0183627 | A1 * | 6/2016 | Ho | A43B 7/146 36/3 B |

* cited by examiner

FOOT MASSAGE PHYSIOTHERAPY PLATES

TECHNICAL FIELD OF THE INVENTION

The utility model relates to a pair of foot massage physiotherapy plates, in particular to a pair of foot massage physiotherapy plates with self-selected foot reflex zones and foot acupuncture points combined corresponding to symptoms.

BACKGROUND

According to the contents recorded in Chinese Historical Records, Yu Fu, a Chinese foot therapist, found that diseases can be treated by massaging feet 5000 years ago. In the same era, there were wall paintings which shown that slaves massaged feet of Pharaoh existing in Pharaoh's tombs in the form of Egyptian pyramids. Sakyamuni, an ancestor of Indian Buddhism left a human body internal organ drawing for treating diseases from foot soles before passing away 2500 years ago. Hua Tuo, a Chinese famous doctor, specially carried out researches on reflexology to treat diseases from foot soles 1800 years ago. In Han and Tang dynasties, Esoterica of Hua Tun about reflexology therapy was published. Reflexology therapy was spread to Japan in Tang dynasty and was spread to Europe in Yuan dynasty. In 1917, William Fitzgerald, an American physician, injected the ancient reflexology therapy into neurology and reflexology of western medicine, divided foot soles into holographic reflex zones corresponding to human body organs, compiled and published Zone Therapy about foot holographic reflexology and became a founder of foot reflex zone therapy. Since then, foot reflex zone therapy attracted the attention of the western medicine field and was gradually spread to more than thirty countries and regions around the world. After being further studied and enriched by numerous professionals and scholars, the original foot reflex zone therapy is developed to the foot reflex zone therapy which is world-recognized at present. The foot reflex therapy which was originated from China and developed in the world was spread back to the origin place China in the 1980's, acupuncture and moxibustion, massage and point therapy were newly blended and a new branch science of modern foot holographic diagnosis and treatment medicine was created. With the wide spreading of the foot reflex zone therapy, various special apparatuses and tools which replace manual massage occur in the medical healthcare market, thus promoting the development of the foot holographic therapy towards instrumentation, industrialization and standardization. Various massage shoe pads, massage slippers, massage plates and physiotherapy plates for massaging foot soles emerge in response to the needs of times and play the roles of enriching the medical healthcare market and promoting the heath of the public. But throughout the existing products in the market, most products only borrow the concept of reflex zones and blindly massage foot soles. Although individual products are designed with some shaped massage blocks, the massage blocks cannot accurately stimulate corresponding reflex zones. Even though there are partial massage shoe pads which are manufactured according to shoe sizes, the foot sole reflex zones which need to be stimulated cannot be aligned, the medical effect of massing and stimulating the foot sole reflex zones cannot be achieved, and the treatment and rehabilitation effect by massaging and hitting foot acupuncture points corresponding to symptoms is not achieved.

SUMMARY OF THE INVENTION

In order to solve the problems that the zone positions are not complete, the information is not completely transmitted and the reflex functions are not complete in the foot reflex zone therapy in the prior art, the utility model provides a pair of foot massage physiotherapy plates with self-selected foot reflex zones and foot acupuncture points combined corresponding to symptoms.

The utility model provides a pair of foot massage physiotherapy plates. The foot massage physiotherapy plates comprise bottom plates, foot reflex zone massage blocks and foot acupuncture point massage posts; the foot reflex zone massage blocks are connected with the bottom plates through massage block bolts and the foot acupuncture point massage posts are connected with the foot reflex zone massage blocks through massage post bolts; massage bulges are arranged on the front surfaces of the foot reflex zone massage blocks.

The heights of the foot acupuncture point massage posts and the massage bulges are respectively adaptive to human body foot arches.

The massage bulges are inclined towards moving directions of physiological trends of corresponding human body organs, and an inclination angle of the massage bulges relative to the bottom plates is 60-90 degrees.

The foot reflex zone massage blocks comprise first foot reflex zone massage blocks and second foot reflex zone massage blocks with the same size and shape; the hardness of the first foot reflex zone massage blocks is higher than the hardness of the second foot reflex zone massage blocks, and the hardness of the foot acupuncture point massage posts is higher than the hardness of the first foot reflex zone massage blocks.

First massage block bolt insertion holes are formed in the back surfaces of the foot reflex zone massage blocks, second massage block bolt insertion holes are formed in the front surfaces of the bottom plates, one end of each massage block bolt is connected with the corresponding first massage block bolt insertion hole and the other end is connected with the corresponding second massage block bolt insertion hole.

First massage post bolt insertion holes are formed in the front surfaces of the foot reflex zone massage blocks, second massage post bolt insertion holes are formed in the back surfaces of the foot acupuncture point massage posts, one end of each massage post bolt is connected with the corresponding first massage post bolt insertion hole and the other end is connected with the corresponding second massage post bolt insertion hole.

The foot reflex zone massage blocks include frontal sinus foot reflex zone massage blocks, cerebrum, cerebellum and brainstem foot reflex zone massage blocks, pituitary gland foot reflex zone massage blocks, eye foot reflex zone massage blocks, ear foot reflex zone massage blocks, cervical vertebra and neck foot reflex zone massage blocks, trapezins foot reflex zone massage blocks, a left foot esophagus and trachea foot reflex zone massage block, a right foot pressure reducing point foot reflex zone massage block thyroid gland foot reflex zone massage blocks, accessory thyroid gland foot reflex zone massage blocks, lung and bronchus foot reflex zone massage blocks, shoulder foot reflex zone massage blocks, adrenal gland foot reflex zone massage blocks, stomach, pancreas and duodenum foot reflex zone massage blocks, inner side celiac plexus foot reflex zone massage blocks, outer side celiac plexus foot reflex zone massage blocks, kidney foot reflex zone massage blocks, a left foot heart foot reflex zone massage block, a right foot liver and gallbladder foot reflex zone massage block, a left foot spleen foot reflex zone massage block, motor center foot reflex zone massage blocks, transverse colon and small intestine foot reflex zone massage blocks, ureter foot reflex zone massage blocks, a left foot small intestine foot reflex zone massage block, a right foot small intestine foot reflex zone massage block, a left foot transverse colon, descending colon, rectum and anus foot reflex zone massage block, a right foot cecum, ileocecal valve, ascending colon and transverse colon foot reflex zone massage block, knee foot reflex zone massage blocks, urinary bladder foot reflex zone massage blocks, genital gland foot reflex zone massage blocks, inner tailbone foot reflex zone massage blocks and outer tailbone foot reflex zone massage blocks corresponding to human body foot reflex zones one to one.

The foot acupuncture point massage posts include scalp point foot acupuncture point massage posts, inner side ear point foot acupuncture point massage posts, outer side ear point foot acupuncture point massage posts, inner side eye point foot acupuncture point massage posts, outer side eye point foot acupuncture point massage posts, nose point foot acupuncture point massage posts, mouth point foot acupuncture point massage posts, throat point foot acupuncture point massage posts, regeneration point foot acupuncture point massage posts, trigeminal nerve point foot acupuncture point massage posts, heart point foot acupuncture point massage posts, chest point foot acupuncture point massage posts, third cancer root point foot acupuncture point massage posts, insomnia point foot acupuncture point massage posts, sciatic nerve, vermiform appendix and chest point foot acupuncture point massage posts, first cancer root point foot acupuncture point massage posts, duodenum and dysentery point foot acupuncture point massage posts, asthma and cerebrum point foot acupuncture point massage posts, neurasthenia and neurosis point foot acupuncture point massage posts sole center point foot acupuncture point massage posts, diarrhea, dysentery and metritis point foot acupuncture point massage posts, Yongquan point foot acupuncture point massage posts, gastro spasm and gastroenteritis point foot acupuncture point massage posts, shoulder and urticaria point foot acupuncture point massage posts, urinary bladder point foot acupuncture point massage posts, inner Linqi point foot acupuncture point massage posts, second cancer root point foot acupuncture point massage posts, genital point foot acupuncture point massage posts, inner Xiangu point foot acupuncture point massage posts, Yadian point foot acupuncture point massage posts, anus point foot acupuncture point massage posts, inner Xiaxi point foot acupuncture point massage posts, inner Neiting point foot acupuncture point massage posts, Niaodian point foot acupuncture point massage posts, inner Taichong point foot acupuncture point massage posts, thumbprint point foot acupuncture point massage posts and Duyin point foot acupuncture point massage posts corresponding to human body foot acupuncture points one to one.

The utility model has the following beneficial effects:

(1) Since the design of fixed massage blocks for only massaging foot reflex zones is changed and the detachably installed foot acupuncture point massage posts are arranged on the detachably installed foot reflex zone massage blocks, when the situations that the zone positions are not complete, the information is not completely transmitted and the reflex functions are not complete occur in the foot reflex zone therapy, hitting and massaging foot acupuncture points can make up the situation of incompleteness occurring in the foot reflex zone therapy, hitting and massaging the foot acupuncture points while massaging the foot reflex zones will achieve the effect of complementation of functions of two therapies in Chinese and western medicines even through the situation of incompleteness does not exist in the foot reflex zone therapy, the healthcare treatment effect of the foot diagnosis and treatment methods can be obviously improved, the dual medical healthcare effects of massaging the foot reflex zones and massaging and hitting foot acupuncture points can be simultaneously achieved to satisfy different demands of people in different health conditions, and a simple-to-operate, safe, reliable, convenient and effective medical healthcare tool is provided for the public.

(2) The foot reflex zone massage block and the foot acupuncture point massage posts are arranged to have different hardness and are used for effectively massaging and stimulating the foot reflex zones corresponding to the symptoms to treat and cure diseases the low-hardness foot reflex zone massage blocks are used for supplementing vacant positions on the bottom plates of the physiotherapy plates after combination, the vacant positions are supplemented and the physiotherapy plates are comfortable and health-promoting.

(3) The massage bulges on each of the foot reflex zone massage blocks are manufactured towards an inclination angle to which pushing force is directed to massage along moving directions of physiological trends of human body organs according to the human organs physiological trends and the standard of the foot massage therapy direction, the natural coordination function and natural repair capacity of the human body organs are improved through stimulation.

(4) Since the design height of the foot reflex zone massage blocks and the foot acupuncture point massage posts is in close fit with the arch shapes of foot soles, the stimulation amount is kept to be enough.

Figure 1:
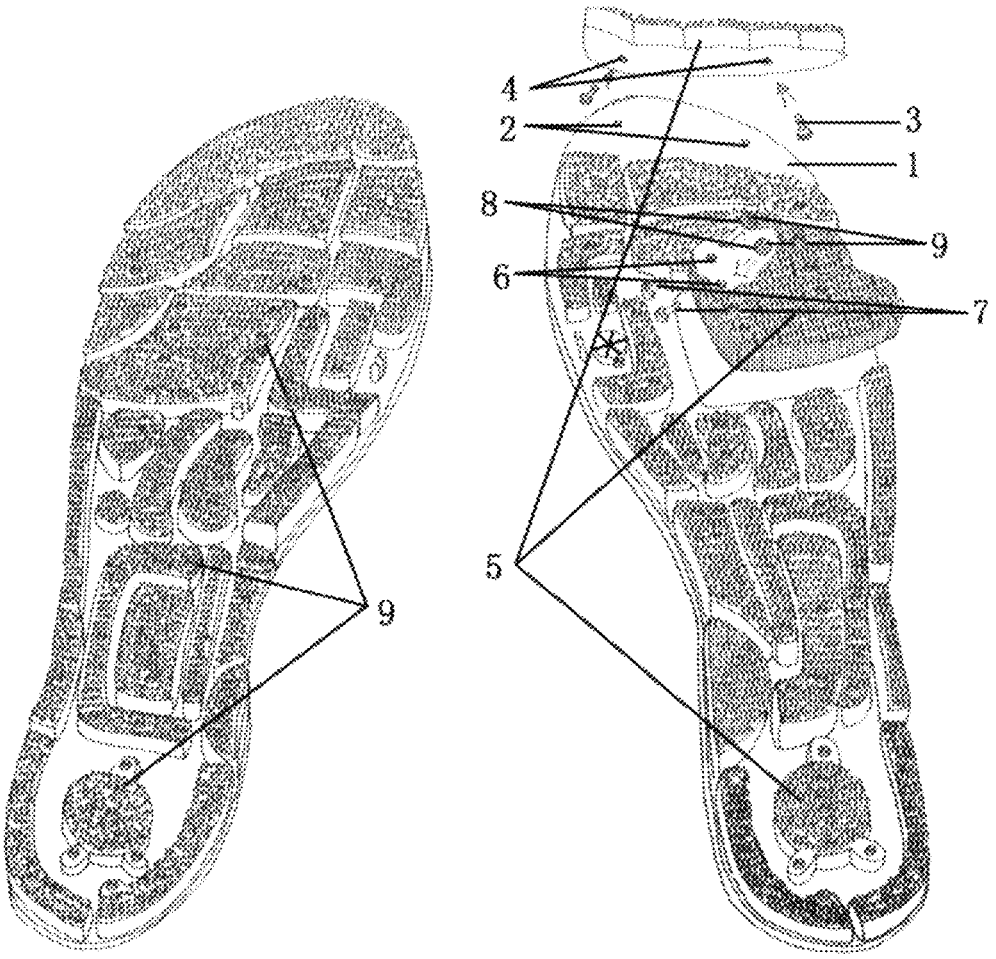
FIG. 1 is a schematic view of a structure of foot massage physiotherapy plates according to the utility model.

wherein, 1-bottom plate; 2-second massage block bolt insertion hole; 3-massage block bolt; 4-first massage block bolt insertion hole; 5-foot reflex zone massage block; 6-first massage post bolt insertion hole; 7-massage post bolt;

8-second massage post bolt insertion hole; 9-foot acupuncture point massage post; 10-frontal sinus foot reflex zone massage block; 11-cerebrum, cerebellum and brainstem foot reflex zone massage block; 12-pituitary gland foot reflex zone massage block; 13-eye foot reflex zone massage block; 14-ear foot reflex zone massage block; 15-cervical vertebra and neck foot reflex zone massage block; 16-trapezius foot reflex zone massage block; 17-left foot esophagus and trachea foot reflex zone massage block; 18-right foot pressure reducing point foot reflex zone massage block; 19-thyroid gland foot reflex zone massage block; 20-accessory thyroid gland foot reflex zone massage block; 21-lung and bronchus foot reflex zone massage block; 22-shoulder foot reflex zone massage block; 23-adrenal gland foot reflex zone massage block; 24-stomach, pancreas and duodenum foot reflex zone massage block; 25-inner side celiac plexus foot reflex zone massage block; 26-outer side celiac plexus foot reflex zone massage block; 27-kidney foot reflex zone massage block; 28-left foot heart foot reflex zone massage block; 29-right foot liver and gallbladder foot reflex zone massage block; 30-left foot spleen foot reflex zone massage block; 31-motor center foot reflex zone massage block; 32-transverse colon and small intestine foot reflex zone massage block; 33-ureter foot reflex zone massage block; 34-left foot small intestine foot reflex zone massage block; 35-right foot small intestine foot reflex zone massage block; 36-left foot transverse colon, descending colon, rectum and anus foot reflex zone massage block; 37-right foot cecum ileocecal valve, ascending colon and transverse colon foot reflex zone massage block; 38-knee foot reflex zone massage block; 39-urinary bladder foot reflex zone massage block; 40-genital gland foot reflex zone massage block; 41-inner tailbone foot reflex zone massage block; 42-outer tailbone foot reflex zone massage block; 43-scalp point foot acupuncture point massage post; 44-inner side ear point foot acupuncture point massage post; 45-outer side ear point foot acupuncture point massage post; 46-inner side eye point foot acupuncture point massage post; 47-outer side eye point foot acupuncture point massage pot; 48-nose point foot acupuncture point massage post; 49-mouth point foot acupuncture point massage post; 50-throat point foot acupuncture point massage post; 51-regeneration point foot acupuncture point massage post; 52-trigeminal nerve point foot acupuncture point massage post; 53-heart point foot acupuncture point massage post; 54-chest point foot acupuncture point massage post; 55-third cancer root point foot acupuncture point massage post; 56-insomnia point foot acupuncture point massage post; 57-sciatic nerve, vermiform appendix and chest point foot acupuncture point massage post; 58-first cancer root point foot acupuncture point massage post; 59-duodenum and dysentery point foot acupuncture point massage post; 60-asthma and cerebrum point foot acupuncture point massage post; 61-neurasthenia and neurosis point foot acupuncture point massage post; 62-sole center point foot acupuncture point massage post; 63-diarrhea, dysentery and metritis point foot acupuncture point massage post; 64-Yongquan point foot acupuncture point massage post; 65-gastro spasm and gastroenteritis point foot acupuncture point massage post; 66-shoulder and urticaria point foot acupuncture point massage post; 67-urinary; bladder point foot acupuncture point massage post; 68-inner Linqi point foot acupuncture point massage post; 69-second cancer root point foot acupuncture point massage post; 70-genital point foot acupuncture point massage post; 71-inner Xiangu point foot acupuncture point massage post; 72-Yadian point foot acupuncture point massage post; 73-anus point foot acupuncture point massage post; 74-inner Xiaxi point foot acupuncture point massage post; 75-inner Neiting point foot acupuncture point massage post; 76-Niaodian point foot acupuncture point massage post; 77-inner Taichong point foot acupuncture point massage post; 78-thumbprint point foot acupuncture point massage post; 79-Duyin point foot acupuncture point massage post.

DETAIL DESCRIPTION OF THE INVENTION

The structure of the utility model is explained and described below in detail in combination with the drawings and the embodiments.

Embodiment 1

Figure 2:
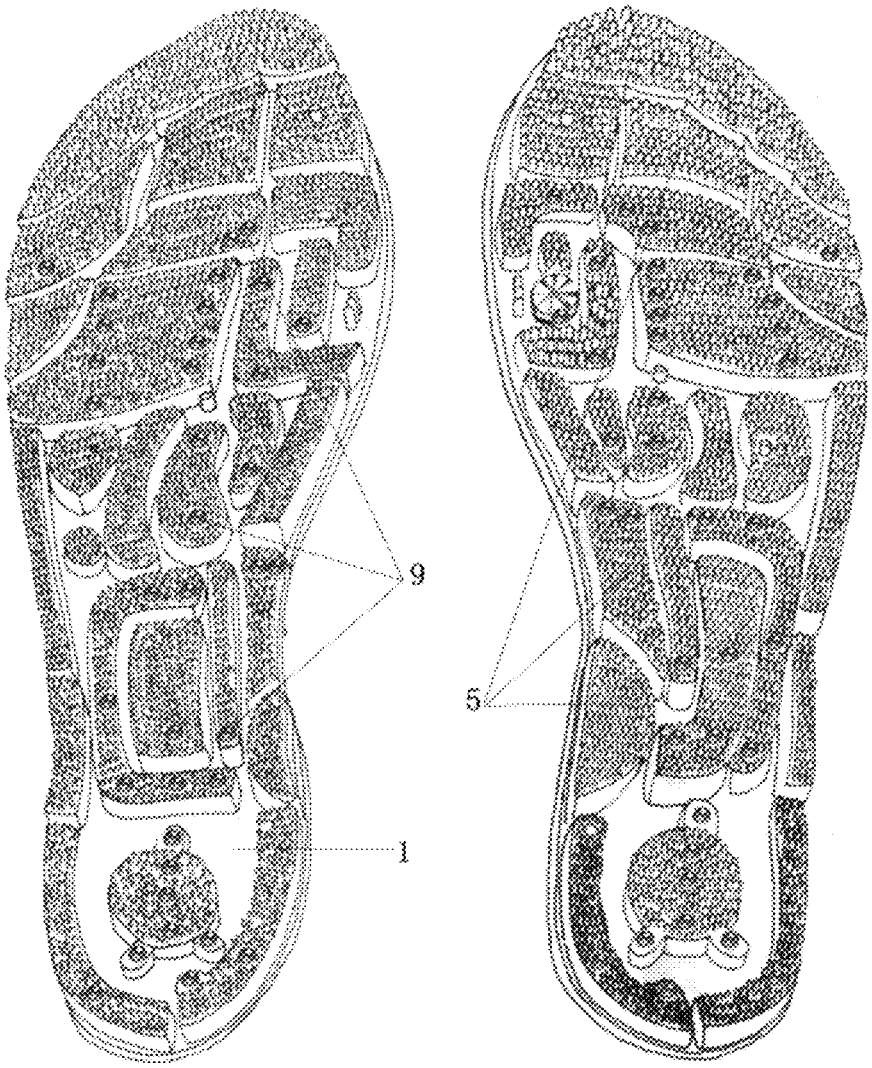
FIG. 2 is a schematic view of an overall structure of foot massage physiotherapy plates according to the utility model.

As shown in FIG. 1 and FIG. 2, foot massage physiotherapy plates provided by the utility model comprise bottom plates 1, foot reflex zone massage blocks 5 and foot acupuncture point massage posts 9; the foot reflex zone massage blocks 5 are connected with the bottom plates through massage block bolts 3 and the foot acupuncture point massage posts 9 are connected with the foot reflex zone massage blocks 5 through massage post bolts 7; massage bulges are arranged on the front surfaces of the foot reflex zone massage blocks 5.

First massage block bolt insertion holes 4 are formed in the back surfaces of the foot reflex zone massage blocks 5, second block bolt insertion holes 2 are formed in the front surfaces of the bottom plates 1, one end of each massage block bolt 3 is movably connected with the corresponding first massage block bolt insertion hole 4 and the other end is movably connected with the corresponding second massage block bolt insertion hole 2.

First massage post bolt insertion holes 6 are formed in the front surfaces of the foot reflex zone massage blocks 5, second massage post bolt insertion holes 8 are formed in the back surfaces of the foot acupuncture point massage posts 9, one end of each massage post bolt 7 is movably connected with the corresponding first massage post bolt insertion hole 6 and the other end is movably connected with the corresponding second massage post bolt insertion hole 8.

The foot massage physiotherapy plates provided by the utility model have the beneficial effects that since the design of fixed massage blocks for only massaging foot reflex zones is changed and the detachably installed foot acupuncture point massage posts are arranged on the detachably installed foot reflex zone massage blocks, when the situations that the zone positions are not complete, the information is not completely transmitted and the reflex functions are not complete occur in the foot reflex zone therapy, hitting and massaging foot acupuncture points can make up the situation of incompleteness occurring in the foot reflex zone therapy, hitting and massaging the foot acupuncture points while massaging the foot reflex zones will achieve the effect of complementation of functions of two therapies in Chinese and western medicines even through the situation of incompleteness does not exist in the foot reflex zone therapy, the healthcare treatment effect of the foot diagnosis and treatment methods can be obviously improved, and the dual medical healthcare effects of massaging the foot reflex zones and massaging and hitting foot acupuncture points can be simultaneously achieved.

Figure 3:
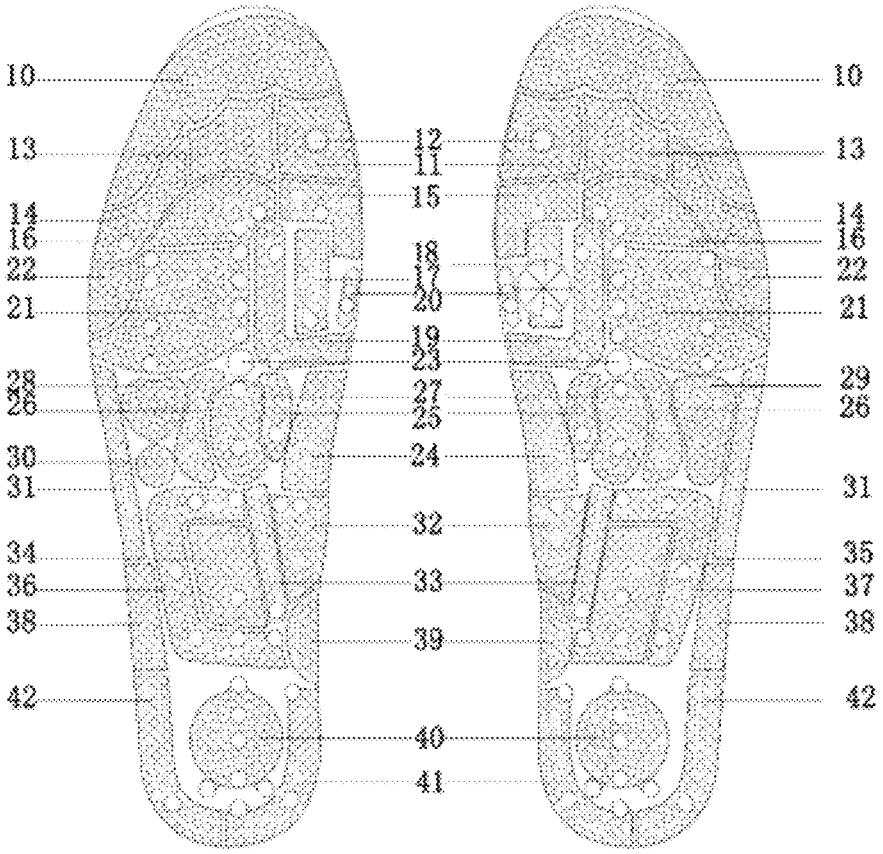
FIG. 3 is a schematic view of plane layout of foot reflex zone massage blocks of foot massage physiotherapy plates according to the utility model.

The foot reflex zone massage blocks 5 are marked according to a foot reflex zone map in Section 2, Chapter 24 of Complete Collection of Holographic Medicine. Foot reflex zone massage blocks of frontal sinus, cerebrum, cerebellum and brainstem pituitary gland, eyes, ears, cervical vertebra and neck, trapeziuses, esophagus and trachea (left foot), pressure reducing point (right foot), thyroid gland, accessory thyroid gland, lung and bronchus, shoulders, adrenal gland, stomach, pancreas and duodenum, celiac plexus (inner side), celiac plexus (outer side), kidneys, heart (left foot), liver and gallbladder (right foot), spleen (left foot), motor center, transverse colon and small intestine (inner side), transverse colon and small intestine (outer side), ureter, small intestine (left foot) small intestine (right foot), transverse colon, descending colon, rectum and anus (left foot), cecum ileocecal valve, ascending colon and transverse colon (right foot), knees, urinary bladder, genital gland, inner tailbone and outer tailbone are arranged on two feet from top to bottom. As shown in FIG. 3, the foot reflex zone massage blocks 5 include frontal sinus foot reflex zone massage blocks 10, cerebrum, cerebellum and brainstem foot reflex zone massage blocks 11, pituitary gland foot reflex zone massage blocks 12, eye foot reflex zone massage blocks 13, ear foot reflex zone massage blocks 14, cervical vertebra and neck foot reflex zone massage blocks 15, trapezius foot reflex zone massage blocks 16, a left foot esophagus and trachea foot reflex zone massage block 17, a right foot pressure reducing point foot reflex zone massage block 18, thyroid gland foot reflex zone massage blocks 19, accessory thyroid gland foot reflex zone massage blocks 20, lung and bronchus foot reflex zone massage blocks 21, shoulder foot reflex zone massage blocks 22, adrenal gland foot reflex zone massage blocks 23, stomach, pancreas and duodenum foot reflex zone massage blocks 24, inner side celiac plexus foot reflex zone massage blocks 25, outer side celiac plexus foot reflex zone massage blocks 26, kidney foot reflex zone massage blocks 27, a left foot heart foot reflex zone massage block 28, a right foot liver and gallbladder foot reflex zone massage block 29, a left foot spleen foot reflex zone massage block 30, motor center foot reflex zone massage blocks 31, transverse colon and small intestine foot reflex zone massage blocks 32, ureter foot reflex zone massage blocks 33, a left foot small intestine foot reflex zone massage block 34, a right foot small intestine foot reflex zone massage block 35, a left foot transverse colon, descending colon, rectum and anus foot reflex zone massage block 36, a right foot cecum, ileocecal valve, ascending colon and transverse colon foot reflex zone massage block 37, knee foot reflex zone massage blocks 38, urinary bladder foot reflex zone massage blocks 39, genital gland foot reflex zone massage blocks 40, inner tailbone foot reflex zone massage blocks 41 and outer tailbone foot reflex zone massage blocks 42.

For foot reflex zones and massage indications corresponding to the above-mentioned foot reflex zone massage blocks 5, please refer to Table 1 for selecting plate combination corresponding to symptoms in use.

TABLE 1

Cross-reference Table of Foot Reflex Zones and Massage Indications Corresponding to Foot Reflex Zone Massage Blocks

| Name of foot reflex zone massage block | Name of corresponding foot reflex zone | Massage indications |
|---|---|---|
| Frontal sinus foot reflex zone massage blocks 10 | Frontal sinus | Headache, dizziness, insomnia, fever, sequela of cerebral apoplexy, mental fatigue, nervous tension, poor appetite, various cerebral diseases and nose, eye, ear and oral cavity diseases |
| Cerebrum, cerebellum and brainstem foot reflex zone massage blocks 11 | Cerebrum, cerebellum and brainstem | Sequela of cerebral apoplexy, various cerebral diseases, high blood pressure, low blood pressure, headache, dizziness, insomnia, neurasthenia, hearing and eyesight impairment, motor disorder, muscular atrophy, walking imbalance, various pains, digestive system lesions, weight losing and diseases related to central nerve |
| Pituitary gland foot reflex zone massage blocks 12 | Pituitary gland | Weight losing, teenager height increase, infertility, blood pressure increase, age defying, climacteric syndrome, and endocrine disorder diseases related to thyroid gland, accessory thyroid gland, adrenal gland, genital gland, pancreas, etc. |
| Eye foot reflex zone massage blocks 13 | Eyes | Myopia, hyperopia, mild glaucoma, mild cataract, keratitis, conjunctivitis, hordeolum, asthenopia, presbyopia, etc. |
| Ear foot reflex zone massage blocks 14 | Ears | Otitis media, tinnitus, deafness, Menierss syndrome, vertigo, disequilibrium |
| Cervical vertebra and neck foot reflex zone massage blocks 15 | Cervical vertebra and neck | Neck and shoulder sore, neck stiffness, cervical vertebra diseases, periarthritis of shoulders, stiff neck, upper limb weakness, hand numbness and pain, and high blood pressure, headache and dizziness caused by cervical vertebra diseases |
| Trapezius foot reflex zone massage blocks 16 | Trapeziuses | Cervical vertebra diseases, periarthritis of shoulders, stiff neck, neck shoulder and back sore, fasciitis and upper limb weakness |

TABLE 1-continued

Cross-reference Table of Foot Reflex Zones and Massage Indications Corresponding to Foot Reflex Zone Massage Blocks

| Name of foot reflex zone massage block | Name of corresponding foot reflex zone | Massage indications |
|---|---|---|
| Left foot esophagus and trachea foot reflex zone massage block 17 | Esophagus and trachea | Esophagus and trachea lesions, esophagitis, diverticulum, globus hysteriocus and trachitis |
| Right foot pressure reducing point foot reflex zone massage block 18 | Pressure reducing point | By pressing this position, sympathetic nerve excitability is reduced and vagus nerve excitability is increased so that too fast heart rate is reduced, high blood pressure is decreased and low blood pressure is increased. By continuously massaging this position, stubborn high blood pressure to which the effect of oral-taking blood pressure decreasing drugs is poor can also be decreased to a normal standard. |
| Thyroid gland foot reflex zone massage blocks 19 | Thyroid gland | Weight losing, blood fat reduction, cholesterol decomposition, metabolism promotion, thyroid hypofunction, thyroid enlargement, thyroid hyperfunction, endocrine dysfunction, neurasthenia, skin diseases, gynecological diseases, diabetes and cardiovascular diseases |
| Accessory thyroid gland foot reflex zone massage blocks 20 | Accessory thyroid gland | Tetany, calcium deficiency of teenagers, senile osteoporosis, nervous spasm, muscle and bone sore, cataract, hypersensitivity, insomnia, emesis, gynecological diseases and skin diseases |
| Lung and bronchus foot reflex zone massage blocks 21 | Lung and bronchus | Lung and pleura lesions, pneumonia, pulmonary emphysema, pleuritis, trachitis, cough, asthma, chest distress and respiratory system diseases |
| Shoulder foot reflex zone massage blocks 22 | Shoulders | Periarthritis of shoulders, cervical vertebra diseases, shoulder and back pain, upper limb weakness and hip bone, knee, elbow, ankle and wrist joint pain |
| Adrenal gland foot reflex zone massage blocks 23 | Adrenal gland | Anti-shock, anti-anaphylaxis, anti-poisoning, blood pressure increase, heart rate acceleration, myocardial ischemia improvement; rheumatism, arthritis, impotence, asthma, cold hands and feet and lower limb weakness |
| Stomach, pancreas and duodenum foot reflex zone massage blocks 24 | Stomach, pancreas and duodenum | Gastritis, gastro spasm, gastroptosis, gastric and duodenal ulcer, anorexia, emesis, dyspepsia, poor appetite, diabetes, pancreatitis and obesity |
| Inner side celiac plexus foot reflex zone massage blocks 25 and outer side celiac plexus foot reflex zone massage blocks 26 | Celiac plexus | Circulatory, respiratory, digestive and urogenital system diseases, high blood pressure, low blood pressure, diabetes, abdominal distension, diarrhea, hiccup, spasm, chest distress, ocular diseases, and bidirectional regulation of sympathetic and parasympathetic nerves |
| Kidney foot reflex zone massage blocks 27, ureter foot reflex zone massage blocks 33 and urinary bladder foot reflex zone massage blocks 39 | Kidney, ureter and urinary bladder | Important excretory organs, which can drain pathological objects in urinary bladders out of bodies, drain toxicants and generate blood; effective for high blood pressure, prostatitis, kidney stone, urinary stone, bladder stone, nephritis, urocystitis, dysuresia, odynuria and urgent urination, headache, edema, infertility, impotence and rheumatoid arthritis |

TABLE 1-continued

Cross-reference Table of Foot Reflex Zones and Massage Indications Corresponding to Foot Reflex Zone Massage Blocks

| Name of foot reflex zone massage block | Name of corresponding foot reflex zone | Massage indications |
|---|---|---|
| Left foot heart foot reflex zone massage block 28 | Heart | High blood pressure, low blood pressure, arrhythmia, arteriosclerosis, varicosity, palpitation, panic, chest distress, tumescence, costalgia, dysphoria, hyperlipidemia and myocarditis |
| Right foot liver and gallbladder foot reflex zone massage block 29 | Liver and gallbladder | Chronic hepatitis, dyspepsia, cholecystitis, cholelithiasis, dyspepsia, poor appetite, poor eyesight and gastrointestinal dysfunction |
| Left foot spleen foot reflex zone massage block 30 | Spleen | Various infectious diseases, poor appetite, dyspepsia, anorexia, organ sagging, constipation, diarrhea, anemia, diabetes, skin diseases, psoriasis, neurodermatitis and irregular menstruation |
| Motor center foot reflex zone massage blocks 31 | Motor center | Lumbago and backache and motor system arthralgia |
| Transverse colon and small intestine foot reflex zone massage blocks 32, left foot small intestine foot reflex zone massage block 34 and right foot small intestine foot reflex zone massage block 35 | Transverse colon and small intestine | Malnutrition, oral cavity erosion, neck pain, dizziness, tinnitus, palpitation, dysphoria, flatulence, abdominal distension, constipation, colonitis and heart disease |
| Left foot transverse colon, descending colon, rectum and anus foot reflex zone massage block 36 and right foot cecum, ileocecal valve, ascending colon and transverse colon foot reflex zone massage block 37 | Cecum, ileocecal valve, ascending colon, transverse colon, descending colon, rectum and anus | Cecum and vermiform appendix lesion, abdominal distension, constipation, gastroenteritis, proctitis, diarrhea, rectocele and hemorrhoid disease |
| Knee foot reflex zone massage blocks 38 | Knee | Knee arthritis and hyperplasia, bony spur, meniscus injury, lumbago and backache, enuresis and dysuresia |
| Genital gland foot reflex zone massage blocks 40 | Genital gland | Mild kidney failure, osteoporosis, climacteric syndrome, senile vaginitis, infertility, impotence, premature ejaculation, testicular and ovarian cyst, dysmenorrhea, pseudo amenorrhea and premenstrual tension syndrome |
| Inner tailbone foot reflex zone massage blocks 41 | Inner tailbone | Headache, ischialgia, talalgia, hernia, enuresis, nocturnal emission, irregular menstruation, tailbone injury, neurasthenia and insomnia |
| Outer tailbone foot reflex zone massage blocks 42 | Outer tailbone | Talalgia, hernia, enuresis, nocturnal emission, irregular menstruation, tailbone injury, neurasthenia and insomnia |

Figure 4:
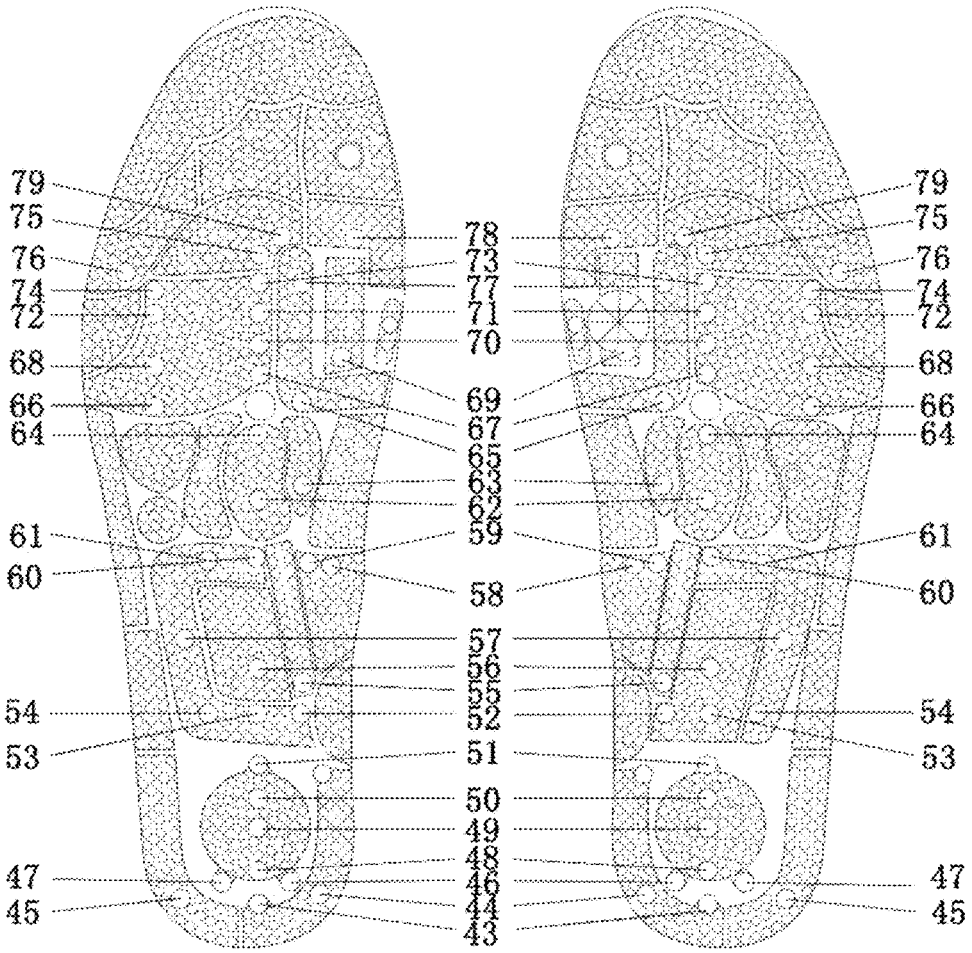
FIG. 4 is a schematic view of installation positions of foot acupuncture point massage posts of foot massage physiotherapy plates according to the utility model.

The foot acupuncture point massage posts 9 are marked according to a foot acupuncture point map in Chapter 24 of Complete Collection of Holographic Medicine. Foot acupuncture point massage posts of scalp point, ear point, eye point, nose point, mouth point, throat point, regeneration point, trigeminal nerve point, heart point, chest point, third cancer root point, insomnia point, sciatic nerve, vermiform appendix and chest point, first cancer root point, duodenum and dysentery point, chest point, neurasthenia and neurosis point, diarrhea, dysentery and metritis point, sole center point, Yongquan point, gastro spasm and gastroenteritis point, shoulder and urticaria point, second cancer root point, urinary bladder point, inner Linqi point, genital point, inner Xiangu point, Yadian point, inner Taichong point, anus point, inner Xiaxi point, Niaodian point, inner Neiting point, thumbprint point and Duyin point are arranged on two feet from bottom to top. As shown in FIG. 4, the foot acupuncture point massage posts 9 include scalp point foot acupuncture point massage posts 43, inner side ear point foot acupuncture point massage posts 44, outer side ear point foot acupuncture point massage posts 45, inner side eye point foot acupuncture point massage posts 46, outer side eye point foot acupuncture point massage posts 47, nose point foot acupuncture point massage posts 48, mouth point foot acupuncture point massage posts 49, throat point foot acupuncture point massage posts 50, regeneration point foot acupuncture point massage posts 51, trigeminal nerve point foot acupuncture point massage posts 52, heart point foot acupuncture point massage posts 53, chest point foot acupuncture point massage posts 54, third cancer root point foot acupuncture point massage posts 55, insomnia point foot acupuncture point massage posts 56, sciatic nerve, vermiform appendix and chest point foot acupuncture point massage posts 57, first cancer root point foot acupuncture point massage posts 58, duodenum and dysentery point foot acupuncture point massage posts 59, asthma and cerebrum point foot acupuncture point massage posts 60, neurasthenia and neurosis point foot acupuncture point massage posts 61, sole center point foot acupuncture point massage posts 62, diarrhea, dysentery and metritis point foot acupuncture point massage posts 63, Yongquan point foot acupuncture point massage posts 64, gastro spasm and gastroenteritis point foot acupuncture point massage posts 65, shoulder and urticaria point foot acupuncture point massage posts 66, urinary bladder point foot acupuncture point massage posts 67, inner Linqi point foot acupuncture point massage posts 68, second cancer root point foot acupuncture point massage posts 69, genital point foot acupuncture point massage posts 70, inner Xiangu point foot acupuncture point massage posts 71, Yadian point foot acupuncture point massage posts 72, anus point foot acupuncture point massage posts 73, inner Xiaxi point foot acupuncture point massage posts 74, inner Neiting point foot acupuncture point massage posts 75, Niaodian point foot acupuncture point massage posts 76, inner Taichong point foot acupuncture point massage posts 77, thumbprint point foot acupuncture point massage posts 78 and Duyin point foot acupuncture point massage posts 79.

For foot acupuncture points and main treatment ranges corresponding to the above-mentioned foot acupuncture point massage posts 9, please refer to Table 2 for selecting plate combination corresponding to symptoms in use.

TABLE 2

Applicable Table of Foot Acupuncture Points and Main Treatment Ranges Corresponding to Foot Acupuncture Point Massage Posts

| Name of foot acupuncture point massage post | Name of corresponding foot acupuncture point | Main treatment range |
|---|---|---|
| Scalp point foot acupuncture point massage posts 43 | Scalp point | Headache, toothache, cold, maxillary sinusitis |
| Inner side ear point foot acupuncture point massage posts 44 and outer side ear point foot acupuncture point massage posts 45 | Ear point | Tinnitus, hypacusia and deafness |
| Inner side eye point foot acupuncture point massage posts 46 and outer side eye point foot acupuncture point massage posts 47 | Eye point | Chronic eye diseases |
| Nose point foot acupuncture point massage posts 48 | Nose point | Various nasitis and nasosinusitis |
| Mouth point foot acupuncture point massage posts 49 | Mouth point | Toothache, sore throat, amygdalitis, cold and fatigue |
| Throat point foot acupuncture point massage posts 50 | Throat point | Fever, pharyngitis, amygdalitis and cold |
| Regeneration point foot acupuncture point massage posts 51 | Regeneration point | Intracranial hematoma, spinal cord swelling and pain, pantalgia and symptom improvement |
| Trigeminal nerve point foot acupuncture point massage posts 52 | Trigeminal nerve point | Prosopalgia |
| Heart point foot acupuncture point massage posts 53 | Heart point | High blood pressure, low blood pressure and neurasthenia |
| Chest point foot acupuncture point massage posts 54 | Chest point | Intercostal neuralgia, chest distress and chest pain |
| Third cancer root point foot acupuncture point | Third cancer root point | Having pain alleviation, pain relief and symptom improvement effects to tumors on esophagus, lung, neck, |

TABLE 2-continued

Applicable Table of Foot Acupuncture Points and Main Treatment Ranges Corresponding to Foot Acupuncture Point Massage Posts

| Name of foot acupuncture point massage post | Name of corresponding foot acupuncture point | Main treatment range |
|---|---|---|
| massage posts 55 | | nose and throat |
| Insomnia point foot acupuncture point massage posts 56 | Insomnia point | Insomnia and neurasthenia |
| Sciatic nerve, vermiform appendix and chest point foot acupuncture point massage posts 57 | Sciatic nerve, vermiform appendix and chest point | Ischialgia, appendicitis and chest pain |
| First cancer root point foot acupuncture point massage posts 58 | First cancer root point | Having pain alleviation and symptom improvement effects to tumors on stomach, cardia and lower section of esophagus |
| Duodenum and dysentery point foot acupuncture point massage posts 59 | Duodenum and dysentery point | Dysentery, diarrhea and duodenal ulcer |
| Asthma and cerebrum point foot acupuncture point massage posts 60 | Asthma and cerebrum point | Asthma, cerebrum function insufficiency and slow response |
| Neurasthenia and neurosis point foot acupuncture point massage posts 61 | Neurasthenia and neurosis point | Neurasthenia and neurosis |
| Sole center point foot acupuncture point massage posts 62 | Sole center point | Neurasthenia, neurosis, dizziness and high blood pressure |
| Diarrhea, dysentery and metritis point foot acupuncture point massage posts 63 | Diarrhea, dysentery and metritis point | Diarrhea, dysentery and metritis |
| Yongquan point foot acupuncture point massage posts 64 | Yongquan point | High blood pressure, shock, headache, dizziness and heart blood supply insufficiency |
| Gastro spasm and gastroenteritis point foot acupuncture point massage posts 65 | Gastro spasm and gastroenteritis point | Gastroenteritis and gastro spasm |
| Shoulder and urticaria point foot acupuncture point massage posts 66 | Shoulder and urticaria point | Shoulder pain, shoulder perimeter pain and urticaria |
| Urinary bladder point foot acupuncture point massage posts 67 | Urinary bladder point | Uroschesis, enuresis and uroclepsia |
| Inner Linqi point foot acupuncture point massage posts 68 | Inner Linqi point | Hemicrania, sternal rib pain, eye pain, tinnitus and deafness |
| Second cancer root point foot acupuncture point massage posts 69 | Second cancer root point | Having pain alleviation and symptom improvement effects to tumors on internal organs below navel |
| Genital point foot acupuncture point massage posts 70 | Genital point | Irregular menstruation, leucorrhea, orchitis and uroschesis |
| Inner Xiangu point foot acupuncture point massage posts 71 | Inner Xiangu point | Acute stomachache and dyspepsia |
| Yadian point foot acupuncture point massage posts 72 | Yadian point | Toothache |
| Anus point foot acupuncture point massage posts 73 | Anus point | Diarrhea and constipation |

TABLE 2-continued

Applicable Table of Foot Acupuncture Points and Main Treatment Ranges Corresponding to Foot Acupuncture Point Massage Posts

| Name of foot acupuncture point massage post | Name of corresponding foot acupuncture point | Main treatment range |
|---|---|---|
| Inner Xiaxi point foot acupuncture point massage posts 74 | Inner Xiaxi point | Acute stomachache and dyspepsia |
| Inner Neiting point foot acupuncture point massage posts 75 | Inner Neiting point | Infantile convulsion |
| Niaodian point foot acupuncture point massage posts 76 | Niaodian point | Enuresis and frequent urination |
| Inner Taichong point foot acupuncture point massage posts 77 | Inner Taichong point | Colic, orchitis, hepatitis, high blood pressure, toothache, sternal rib pain, irregular menstruation, leucorrhea and eye swelling and pain |
| Thumbprint point foot acupuncture point massage posts 78 | Thumbprint point | Orchitis and hernia |
| Duyin point foot acupuncture point massage posts 79 | Duyin point | Hernia and irregular menstruation |

In order to further highlight the effects, the foot reflex zone massage blocks 5 comprise two sets of massage blocks, i.e., respectively first foot reflex zone massage blocks and second foot reflex zone massage blocks with the same size and shape and different hardness, the hardness of the first foot reflex zone massage blocks is higher than the hardness of the second foot reflex zone massage blocks, and the hardness of the foot acupuncture point massage posts 9 is higher than the hardness of the first foot reflex zone massage blocks.

In order to facilitate the understanding, hereafter the first foot reflex zone massage blocks are designed to be dark-color medium-hardness foot reflex zone massage blocks; the second foot reflex zone massage blocks are designed to be light-color low-hardness foot reflex zone massage blocks; the foot acupuncture point massage posts 9 are designed to be high-hardness foot acupuncture point massage posts.

Thereby, the dark-color medium-hardness foot reflex zone massage blocks have enough stimulation strength and are suitable for being combined in basis reflex zones, direct reflex zones and associated reflex zones for plate combination corresponding to symptoms in use; the light-color low-hardness foot reflex zone massage blocks are soft and comfortable and are suitable for being installed in complementary reflex zones to fill vacant positions for healthcare in use; a plurality of high-hardness foot acupuncture point massage posts are selected corresponding to symptoms and then assembled on the foot reflex zone massage blocks of the physiotherapy plates to pertinently prevent, treat and cure diseases by massaging and hitting foot acupuncture points on foot soles.

The foot reflex zone massage blocks 5 and the foot acupuncture point massage posts 9 are selectively combined corresponding to symptoms by referring to the massage indications of the foot reflex zones and the main treatment ranges of the foot acupuncture points in the Complete Collection of Holographic Medicine; the foot reflex zone massage blocks 5 are combined in use by referring to the regulations on the massage indications of the foot reflex zones in the Complete Collection of Holographic Medicine, and the Cross-reference Table of Foot Reflex Zones and Indications Corresponding to Foot Reflex Zone Massage Blocks is compiled; the foot acupuncture point massage posts 9 are combined in use by referring to the regulations on the main treatment ranges of the foot acupuncture points in the Complete Collection of Holographic Medicine, and the Applicable Table of Foot Acupuncture Points and Main Treatment Ranges Corresponding to Foot Acupuncture Point Massage Posts is compiled; the foot reflex zone massage blocks 5 and the foot acupuncture point massage posts 9 are installed in a sequence by referring to the prescription principles of the sequence of basic reflex zones, direct reflex zones, associated reflex zones, complementary reflex zones and foot acupuncture points regulated in the Complete Collection of Holographic Medicine, and a Procedure Table of Selection and Combination of Foot Reflex Zone Massage Blocks 5 and Foot Acupuncture Massage Posts 9 Corresponding to Symptoms is compiled; the foot reflex zone massage blocks 5 and the foot acupuncture massage posts 9 are selected in accordance with the Cross-reference Table of Foot Reflex Zones and Indications. Corresponding to Foot Reflex Zone Massage Blocks, the Applicable Table of Foot Acupuncture Points and Main Treatment Ranges Corresponding to Foot Acupuncture Point Massage Posts and the Procedure Table of Selection and Combination of Foot Reflex Zone Massage Blocks and Foot Acupuncture Massage Posts Corresponding to Symptoms, and are combined and installed according to a sequence regulated by procedures; the foot reflex zone massage blocks 5 and the foot acupuncture point massage posts 9 are selected corresponding to symptoms by referring to the Cross-reference Table of Foot Reflex Zones and Indications Corresponding to Foot Reflex Zone Massage Blocks and the Applicable Table of Foot Acupuncture Points and Main Treatment Ranges Corresponding to Foot Acupuncture Point Massage Posts according to different parts of a user's body to be subjected to healthcare and demands for treating different diseases; the foot reflex zone massage blocks 5 and the foot acupuncture point massage posts 9 are combined and installed in a sequence according to the Procedure Table of Selection and Combination of Foot Reflex Zone Massage Blocks and Foot Acupuncture Massage Posts Corresponding to Symptoms, wherein I corresponds to basic reflex zones, II corresponds to direct reflex zones, III corresponds to associated reflex zones, IV corresponds to complementary reflex zones and V corresponds to foot acupuncture point massage posts.

For the selection and combination procedures of the above-mentioned foot reflex zone massage blocks 5 and foot acupuncture point massage posts 9, please refer to Table 3 for plate combination operation in use.

TABLE 3

Procedure Table of Selection and Combination of Foot Reflex Zone Massage Blocks and Foot Acupuncture Massage Posts Corresponding to Symptoms

| | Combination sequence | | | | |
|---|---|---|---|---|---|
| Selection basis | Foot reflex zone massage blocks in basic reflex zones | Foot reflex zone massage blocks in direct reflex zones | Foot reflex zone massage blocks in associated reflex zones | Foot reflex zone massage blocks in complementary reflex zones | Foot acupuncture point massage posts of foot acupuncture points corresponding to symptoms |
| Selection conditions | According to the rule that the basic reflex zones shall enhance the excretory function in foot reflex zone prescription principles, the dark-color medium-hardness kidney foot reflex zone massage blocks 27, ureter foot reflex zone massage blocks 33 and urinary bladder foot reflex zone massage blocks 39 corresponding to foot excretory system reflex zones are selected and installed on the bottom plates for massaging and stimulating the foot reflex zones corresponding to the excretory system. The above-mentioned three kinds of foot reflex massage blocks are necessarily always used at each time of plate combination. | According to the rule that the direct reflex zones correspond to focuses and symptoms in the foot reflex zone prescription principles, the dark-color medium-hardness foot reflex zone massage blocks corresponding to foot focus and symptom reflex zones are selected and installed on the bottom plates for simulating the foot reflex zones corresponding to organs in which the focuses and symptoms occur. The foot reflex zone massage block is selected corresponding to one focus or one symptom at each time and shall not be multiply selected. If the focus or symptom occurs in the basis reflex zones, the foot reflex zone massage block does | According to the rule that the focuses, causes, natures, symptoms and positions corresponding to the associated reflex zones are associated in the foot reflex zone prescription principles, the dark-color medium-hardness foot reflex zone massage blocks corresponding to the associated reflex zones are selected and installed on the bottom plates for stimulating the foot reflex zones associated with the focuses and symptoms. The associated reflex zones include: 1. Foot reflex zone massage blocks associated with disease names of massage indications. For example, for plate combination for high blood pressure, all reflex zones directly marked for high blood pressure are selected. 2. Foot reflex zone massage blocks associated with causes. For example, various pains are associated with the cerebrum and a pain alleviating effect is achieved by massaging foot cerebrum reflex zones. 3. Foot reflex zone massage blocks associated with disease natures. For example, various inflammations are associated with the immune system and anti-inflammation and pain alleviating effects are achieved by massaging the foot immune system reflex zones. 4. Foot reflex zone massage blocks associated with disease symptoms. For | According to the foot reflex zone prescrip-tion principles, at vacant positions remained after foot reflex zone massage blocks in the basic reflex zones, the direct reflex zones and the associated reflex zones are selected and installed on the bottom plates, light-color low-hard-ness foot reflex zone massage blocks are installed for filling the vacant positions. | According to foot acupuncture point prescrip-tion principles and the applicable table, foot acupuncture point massage posts corresponding to foot acupuncture points are selected and installed on the foot reflex zone massage blocks for hitting and stimulating the foot acupuncture points corresponding to the focuses and the symptoms. |

TABLE 3-continued

| Procedure Table of Selection and Combination of Foot Reflex Zone Massage Blocks and Foot Acupuncture Massage Posts Corresponding to Symptoms | | | | | |
|---|---|---|---|---|---|
| | Combination sequence | | | | |
| Selection basis | Foot reflex zone massage blocks in basic reflex zones | Foot reflex zone massage blocks in direct reflex zones | Foot reflex zone massage blocks in associated reflex zones | Foot reflex zone massage blocks in complementary reflex zones | Foot acupuncture point massage posts of foot acupuncture points corresponding to symptoms |
| | | not need to be selected again. | example, neurasthenia and insomnia symptoms are associated with celiac plexus, and people can be balanced and calmed by massaging. 5. Foot reflex zone massage blocks associated with human body anatomical positions. For example, insomnia is associated with the cerebrum, the frontal sinus, the trigeminal nerve and the cervical vertebra, and insomnia can be improved and eliminated by massaging. | | |
| Mechanisms and effects | By massaging and stimulating the foot basic reflex zones corresponding to the excretory system, the drainage of viruses and metabolites in human bodies can be facilitated and the quick healing of diseases and rehabilitation of bodies can be accelerated. | Foot reflex zones corresponding to the focuses and symptoms can be massaged and stimulated. Automatic regulation and self-repair functions of human bodies are initiated. The normal coordinated state of internal organs is recovered. The rehabilitation of sick organs is facilitated. | By massaging and stimulating the foot associated reflex zones, the roots of diseases and the current symptoms caused by the diseases can be eliminated and improved, the metabolism is accelerated, the immunity is improved and the rehabilitation from difficult and complicated diseases is facilitated. | By slightly stimulating and massaging the foot complementary reflex zones, the comfort is increased and the healthcare effect of bodies can be achieved. | By hitting and stimulating the foot acupuncture points, in combination with massing the foot reflex zones, the medical healthcare effect of two holographic reflex systems is achieved and the quick healing of diseases and the rehabilitation of bodies can be facilitated. |

Each of the foot reflex zone massage blocks 5 is selected by referring to the cross-reference table (Table 1) and the procedure table (Table 3) according to the different parts of the user's body to be subjected to healthcare and different demands for treating and rehabilitating from different diseases and symptoms, the dark-color medium-hardness foot reflex zone massage blocks selected from the foot reflex zone massage blocks 5 according to a sequence of I corresponding to basic reflex zones, II corresponding to direct reflex zones, III corresponding to associated reflex zones and IV corresponding to complementary reflex zones are sequentially installed on the massage block bolts 3 in the second massage block bolt insertion holes 2 on the bottom plates 1 according to an installation sequence of basic reflex zones, direct reflex zones and associated reflex zones, and light-color low-hardness foot reflex zone massage blocks selected from the foot reflex zone massage blocks 5 are installed on the massage block bolts 3 in the second massage block bolt insertion holes 2 at the vacant foot reflex zone positions on the bottom plates 1.

Figure 5:
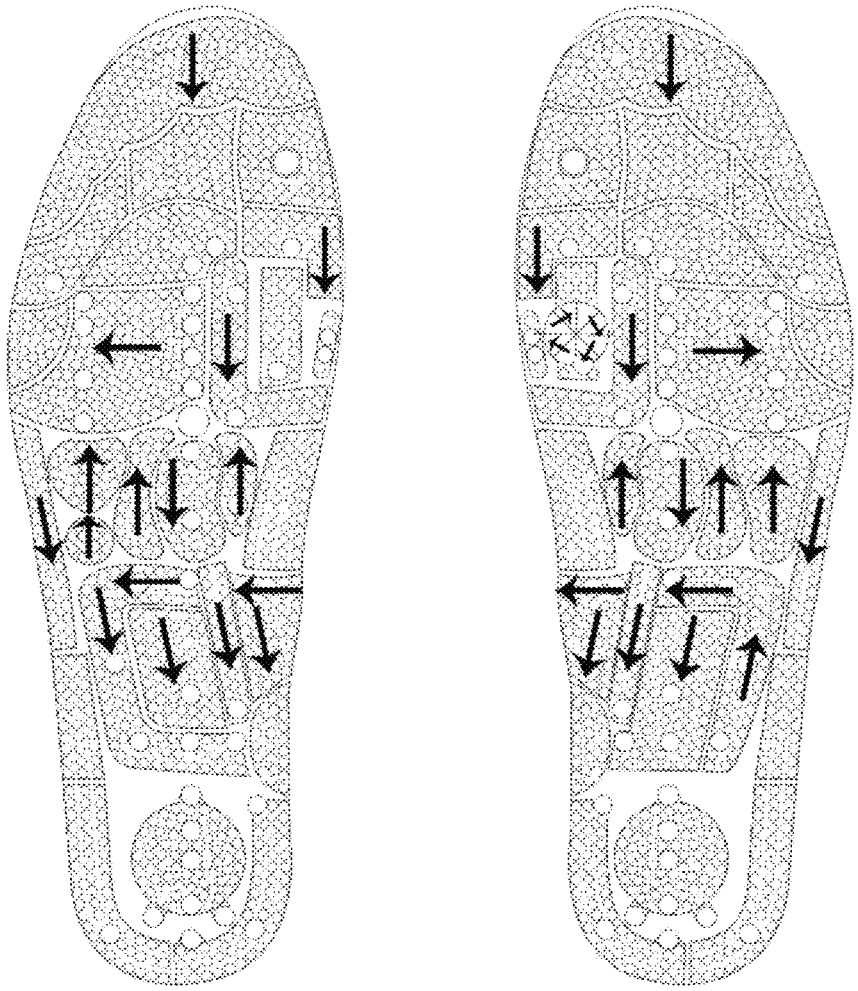
FIG. 5 is a schematic view of massaging directions of foot reflex zone massage blocks of foot massage physiotherapy plates according to the utility model.

As shown in FIG. 5, the massage posts on each of the foot reflex zone massage blocks 5 are manufactured towards an inclination angle to which pushing throe is directed according to the physiological trends of human body organs and the specifications of foot massage directions to massage along the moving directions of the physiological trends of the human body organs, i.e., the massage bulges on each of the foot reflex zone massage blocks 5 are inclined towards the moving directions of the physiological trends of the human body organs, wherein an inclination angle of the massage bulges relative to the bottom plates 1 is 60-90 degrees. For example, the massage bulges on the frontal sinus, cervical vertebra and neck, esophagus and trachea, thyroid gland, stomach, pancreas and duodenum, kidney, ureter and small intestine foot reflex zone massage blocks are inclined and massage towards the direction of heels; the massage posts on the lung and bronchus foot reflex zone massage blocks are inclined and massage towards the direction of foot outer sides; the massage bulges on the cecum ileocecal valve, ascending colon and transverse colon and descending colon, rectum and anus foot reflex zone massage blocks are inclined and massage towards the direction from the cecum on the right foot to the ileocecal valve, ascending colon and transverse colon and the descending colon, rectum and anus; the massage bulges on the cerebrum, cerebellum and brainstem, pituitary gland, eye, ear, trapezius, accessory thyroid gland, shoulder, adrenal gland, motor center, urinary bladder, knee, genital gland, inner tailbone and outer tailbone foot reflex zone massage blocks and all foot acupuncture point massage posts 9 vertically upwards massage, and the natural coordination function and natural repair capacity of the human body organs can be improved by massaging, hitting and stimulating according to the physiological trends of the human body organs. Specifically, the frontal sinus foot reflex zone massage blocks 10, the cervical vertebra and neck foot reflex zone massage blocks 15, the left foot esophagus and trachea foot reflex zone massage block 17, the thyroid gland foot reflex zone massage blocks 19, the stomach, pancreas and duodenum foot reflex zone massage blocks 24, the kidney foot reflex zone massage blocks 27, the motor center foot reflex zone massage blocks 31, the transverse colon and small intestine foot reflex zone massage blocks 32, the ureter foot reflex zone massage blocks 33, the left foot small intestine foot reflex zone massage block 34 and the right foot small intestine foot reflex zone massage block 35 massage towards the direction of heels; the lung and bronchus foot reflex zone massage blocks 21 are inclined and massage towards the direction of foot outer sides; the right foot pressure reducing point foot reflex zone massage block 18 massages towards the anticlockwise direction; the inner side celiac plexus foot reflex zone massage blocks 25, the outer side celiac plexus foot reflex zone massage blocks 26, the left foot heart foot reflex zone massage block 28, the right foot liver and gallbladder foot reflex zone massage block 29 and the left foot spleen foot reflex zone massage block 30 massage towards the direction of toes; the right foot cecum ileocecal valve, ascending colon and transverse colon foot reflex zone massage block 37 and the left foot transverse colon, descending colon, rectum and anus foot reflex zone massage block 36 massage in a direction from a cecum reflex zone to the rectum and the anus according to an intestinal tract running direction; the other foot reflex zone massage blocks and the massage posts on the foot acupuncture point massage posts 9 vertically upwards massage.

As a preferred scheme, the heights of the foot reflex zone massage blocks 5 and the foot acupuncture point massage posts 9 are adaptive to human body foot arches and are in close fit with the physiological curves of the shapes of the foot sole arches, the heights of the parts, in contact with bones, of the foot reflex zone massage blocks 5 and the foot acupuncture point massage posts 9 are consistent with the physiological curves, and the parts, in contact with muscles, of the foot reflex zone massage blocks 5 and the foot acupuncture point massage posts 9 are slightly higher than the physiological curves to maintain enough stimulation amounts, i.e. the heights of the massage bulges of the foot reflex zone massage blocks 5 and the height of the foot acupuncture point massage posts 9 are fit with the physiological curves of the human body foot arches; when the foot reflex zone massage blocks 5 and the height of the foot acupuncture point massage posts 9 are in contact with the bones on human body foot soles, the heights of the foot reflex zone massage blocks 5 and the height of the foot acupuncture point massage posts 9 are consistent with the physiological curves; when the foot reflex zone massage blocks 5 and the height of the foot acupuncture point massage posts 9 are in contact with the muscles on the human body foot soles, the heights of the foot reflex zone massage blocks 5 and the height of the foot acupuncture point massage posts 9 are 1-10 min greater than the physiological curves.

Embodiment 2

Figure 6:
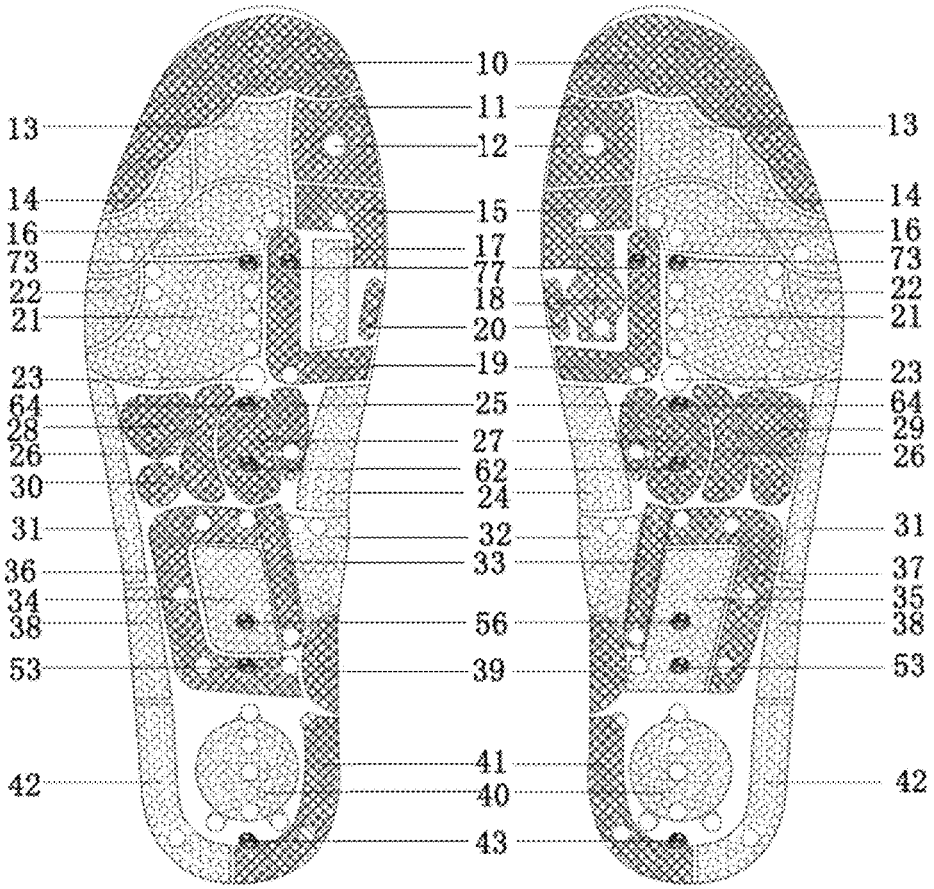
FIG. 6 is a schematic view of a structure of foot massage physiotherapy plates in one embodiment of the utility model.

Combined Foot Massage Physiotherapy Plates corresponding to Symptoms of High Blood Pressure As shown in FIG. 6, firstly see about the cross-reference table (Table 1), the applicable table (Table 2) and the procedure table (Table 3). According to prescription principles for selecting basic reflex zones corresponding to symptoms in I, reflex zones corresponding to functions of opening excretory passages and draining viruses and metabolites are selected, dark-color medium-hardness foot reflex zone massage blocks 5 are adopted, and kidney foot reflex zone massage blocks 27, ureter foot reflex zone massage blocks 33 and urinary bladder foot reflex zone massage blocks 39 are selected and installed on bottom plates 1.

According to prescription principles for selecting direct reflex zones corresponding to symptoms in II, reflex zones corresponding to parts at which focuses occur or main symptoms are selected and dark-color medium-hardness foot reflex zone massage blocks 5 are adopted. Since the part at which the focus of high blood pressure occurs is the heart and the main symptoms are located at the cerebrum, cerebellum and brainstem a left foot heart foot reflex zone massage block 28 and cerebrum, cerebellum and brainstem foot reflex zone massage blocks 11 are selected and installed on the bottom plate 1.

According to prescription principles for selecting associated reflex zones corresponding to symptoms in III, reflex zones associated with focuses and symptoms are selected and dark-color medium-hardness foot reflex zone massage blocks 5 are adopted. Since high blood pressure has reflex zones associated with focuses and symptoms and reflex zones associated with pathogenic causes, such as cervical vertebra diseases which may cause high blood pressure, dark-color medium-hardness cervical vertebra and neck foot reflex zone massage blocks 15 are selected; constipation which may cause high blood pressure, a left foot transverse colon, descending colon, rectum and anus foot reflex zone massage block 36 and a right foot cecum, ileocecal valve, ascending colon and transverse colon foot reflex zone massage block 37 are selected; right foot circulatory system dysfunction which may causes high blood pressure, a right foot liver and gallbladder foot reflex zone massage block 29 and a left foot spleen foot reflex zone massage block 30 are selected; headache which may cause high blood pressure, frontal sinus foot reflex zone massage blocks 10 and inner tailbone foot reflex zone massage blocks 41 are selected; other massage indications which are suitable for high blood pressure in the cross-reference table, a right foot pressure reducing point foot reflex zone massage block 18, thyroid gland foot reflex zone massage blocks 19, accessory thyroid gland foot reflex zone massage blocks 20, inner side celiac plexus foot reflex zone massage blocks 25 and outer side celiac plexus foot reflex zone massage blocks 26 are selected and installed on the bottom plates 1. For all above-mentioned foot reflex zone massage blocks 5 selected corresponding to the symptoms, dark-color foot reflex zone massage blocks 5 with stimulation strength are adopted.

According to prescription principles for selecting complementary reflex zones corresponding, to symptoms in IV, light-color low-hardness foot reflex zone massage blocks 5 for filling vacant reflex zones on the bottom plates 1 are selected. According to vacant positions, pituitary gland foot reflex zone massage blocks 12, eye foot reflex zone massage blocks 13, ear foot reflex zone massage blocks 14, trapezius foot reflex zone massage blocks 16, a left foot esophagus and trachea foot reflex zone massage block 17, lung and bronchus foot reflex zone massage blocks 21, shoulder foot reflex zone massage blocks 22, adrenal gland foot reflex zone massage blocks 23, stomach, pancreas and duodenum foot reflex zone massage blocks 24, motor center foot reflex zone massage blocks 31, transverse colon and small intestine foot reflex zone massage blocks 32, a left foot small intestine foot reflex zone massage block 34, a right foot small intestine foot reflex zone massage block 35, knee foot reflex zone massage blocks 38, genital gland foot reflex zone massage blocks 40 and outer tailbone foot reflex zone massage blocks 42 are sequentially selected and installed on the bottom plates 1. For all above-mentioned foot reflex zone massage blocks 5 selected corresponding to the symptoms, low-hardness light-color foot reflex zone massage blocks 5 are adopted to increase softness and comfort.

According to prescription principles for selecting foot acupuncture points in V, foot acupuncture point massage posts 9 in the applicable ranges of foot acupuncture points corresponding to parts at which focuses and symptoms are located are selected, and scalp point foot acupuncture point massage posts 43, heart point foot acupuncture point massage posts 53, insomnia point foot acupuncture point massage posts 56, sole center point foot acupuncture point massage posts 62. Yongquan point foot acupuncture point massage posts 64, anus point foot acupuncture point massage posts 73 and inner Taichong point foot acupuncture point massage posts 77 are selected and installed on massage post bolts 7 of the foot reflex zone massage blocks 5 on the bottom plates 1.

The combined physiotherapy plates corresponding to the symptoms of high blood pressure are placed in casual shoes consistent with foot shapes and sizes, and then the casual shoes are put on for walking half an hour at morning and evening respectively to massage, hit and stimulate foot sole reflex zones and foot acupuncture points to reduce blood pressure.

By taking high blood pressure as an example, according to clinical trial use within a period of three months in 460 cases, the effective rates of pressure reduction are respectively 89%, 91% and 93%, the significant efficiency rates of pressure reduction are respectively 60%, 67% and 69%, the stopping or reducing rate of long-term taken hypotensive drugs within the clinical trial use period of three months is above 50%, obvious treatment effects and significant social and economic benefits are obtained, and the popularization among people is facilitated.

Embodiment 3

Figure 7:
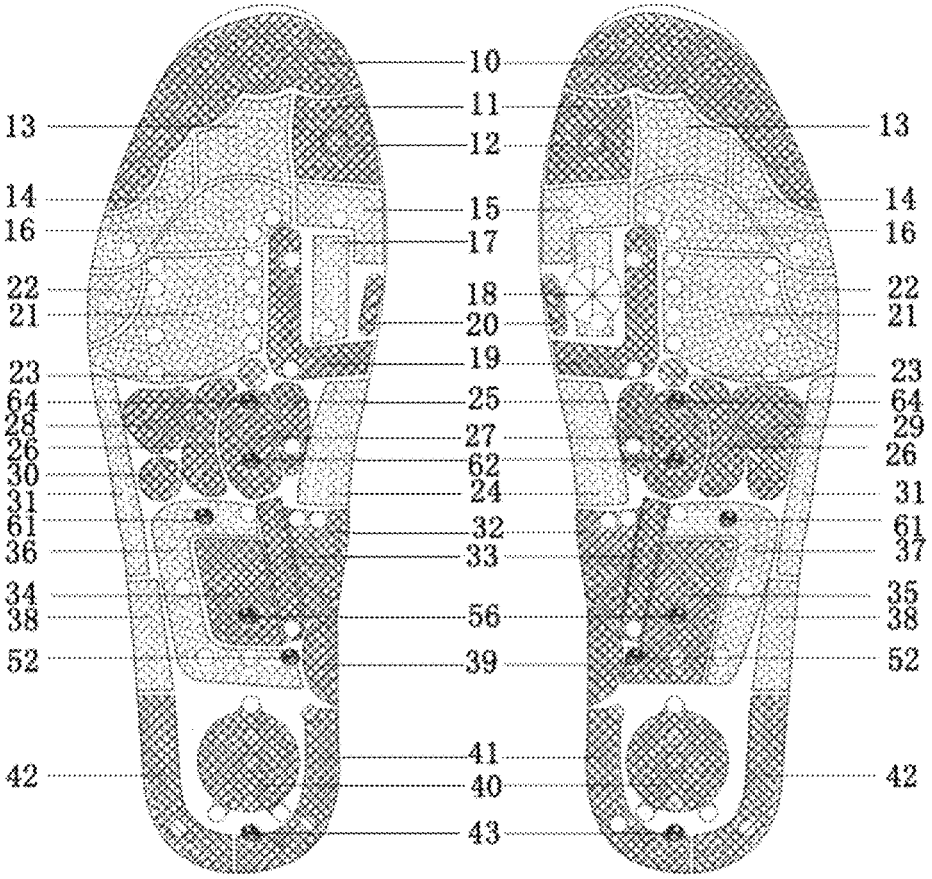
FIG. 7 is a schematic view of a structure of foot massage physiotherapy plates in another embodiment of the utility model.

Combined Foot Massage Physiotherapy Plates corresponding to Symptoms of Insomnia Please refer to FIG. 7, which is a schematic view of an embodiment of combined physiotherapy plates corresponding to symptoms of insomnia of foot sole massaging and point hitting physiotherapy plates with self-selected foot reflex zones and foot acupuncture points combined corresponding to symptoms provided by the utility model. As shown in FIG. 7, firstly see about the cross-reference table (Table 1), the applicable table (Table 2) and the procedure table (Table 3). According to prescription principles for selecting basic reflex zones corresponding to symptoms in I, reflex zones corresponding to functions of opening excretory passages and draining viruses and metabolites are selected, dark-color medium-hardness foot reflex zone massage blocks 5 are adopted, and kidney foot reflex zone massage blocks 27, ureter foot reflex zone massage blocks 33 and urinary bladder foot reflex zone massage blocks 39 are selected and installed on bottom plates 1.

According to prescription principles for selecting direct reflex zones corresponding to symptoms in II, reflex zones corresponding to parts at which focuses occur or main symptoms are selected and dark-color medium-hardness foot reflex zone massage blocks 5 are adopted. Since the parts at which the focus of insomnia occurs are located at the cerebrum, cerebellum and brainstem, cerebrum, cerebellum and brainstem foot reflex zone massage blocks 11 are selected and installed on the bottom plates 1.

According to prescription principles for selecting associated reflex zones corresponding to symptoms in III, reflex zones associated with focuses and symptoms are selected and dark-color medium-hardness foot reflex zone massage blocks 5 are adopted. Since insomnia is associated with frontal sinus, adrenal gland, celiac plexus, heart, liver, gallbladder and spleen, frontal sinus foot reflex zone massage blocks 10, adrenal gland foot reflex zone massage blocks 23, inner side celiac plexus foot reflex zone massage blocks 25, outer side celiac plexus foot reflex zone massage blocks 26, a left foot heart foot reflex zone massage block 28, a right foot liver and gallbladder foot reflex zone massage block 29, a left foot spleen foot reflex zone massage block 30, pituitary gland foot reflex zone massage blocks 12 associated with insomnia, thyroid gland foot reflex zone massage blocks 19, accessory thyroid gland foot reflex zone massage blocks 20, transverse colon and small intestine foot reflex zone massage blocks 32, a left foot small intestine foot reflex zone massage block 34, a right foot small intestine foot reflex zone massage block 35, genital gland foot reflex zone massage blocks 40, inner tailbone foot reflex zone massage blocks 41 and outer tailbone foot reflex zone massage blocks 42 are selected and installed on the bottom plates 1. For all above-mentioned foot reflex zone massage blocks 5 selected corresponding to the symptoms, medium-hardness dark-color foot reflex zone massage blocks 5 with stimulation strength are adopted.

According to prescription principles for selecting complementary reflex zones corresponding to symptoms in IV, light-color low-hardness foot reflex zone massage blocks 5 for filling vacant reflex zones on the bottom plates 1 are selected. According to vacant positions, eye foot reflex zone massage blocks 13, ear foot reflex zone massage blocks 14, cervical vertebra and neck foot reflex zone massage blocks 15, trapezius foot reflex zone massage blocks 16, a left foot esophagus and trachea foot reflex zone massage block 17, a right foot pressure reducing point foot reflex zone massage block 18, lung and bronchus foot reflex zone massage blocks 21, shoulder foot reflex zone massage blocks 22, stomach, pancreas and duodenum foot reflex zone massage blocks 24, motor center foot reflex zone massage blocks 31, a left foot transverse colon, descending colon, rectum and anus foot reflex zone massage block 36, a right foot cecum, ileocecal valve, ascending colon and transverse colon foot reflex zone massage block 37 and knee foot reflex zone massage blocks 38 are sequentially selected and installed on the bottom plates 1. For all above-mentioned selected foot reflex zone massage blocks 5, low-hardness light-color foot reflex zone massage blocks 5 are adopted to increase softness and comfort.

According to prescription principles for selecting foot acupuncture points in V, foot acupuncture point massage posts 9 in the applicable ranges of foot acupuncture points corresponding to parts at which focuses and symptoms are located are selected, and scalp point foot acupuncture point massage posts 43, trigeminal nerve point foot acupuncture point massage posts 52, insomnia point foot acupuncture point massage posts 56, neurasthenia and neurosis point foot acupuncture point massage posts 61, sole center point foot acupuncture point massage posts 62 and Yongquan point foot acupuncture point massage posts 64 are selected and installed on massage post bolts 7 of the foot reflex zone massage blocks 5 on the bottom plates 1.

The combined physiotherapy plates corresponding to the symptoms of insomnia are placed in casual shoes consistent with foot shapes and sizes, and then the casual shoes are put on for walking half an hour at morning and evening respectively to massage, hit and stimulate foot sole reflex zones and foot acupuncture points to improve insomnia.

Embodiment 4

Figure 8:
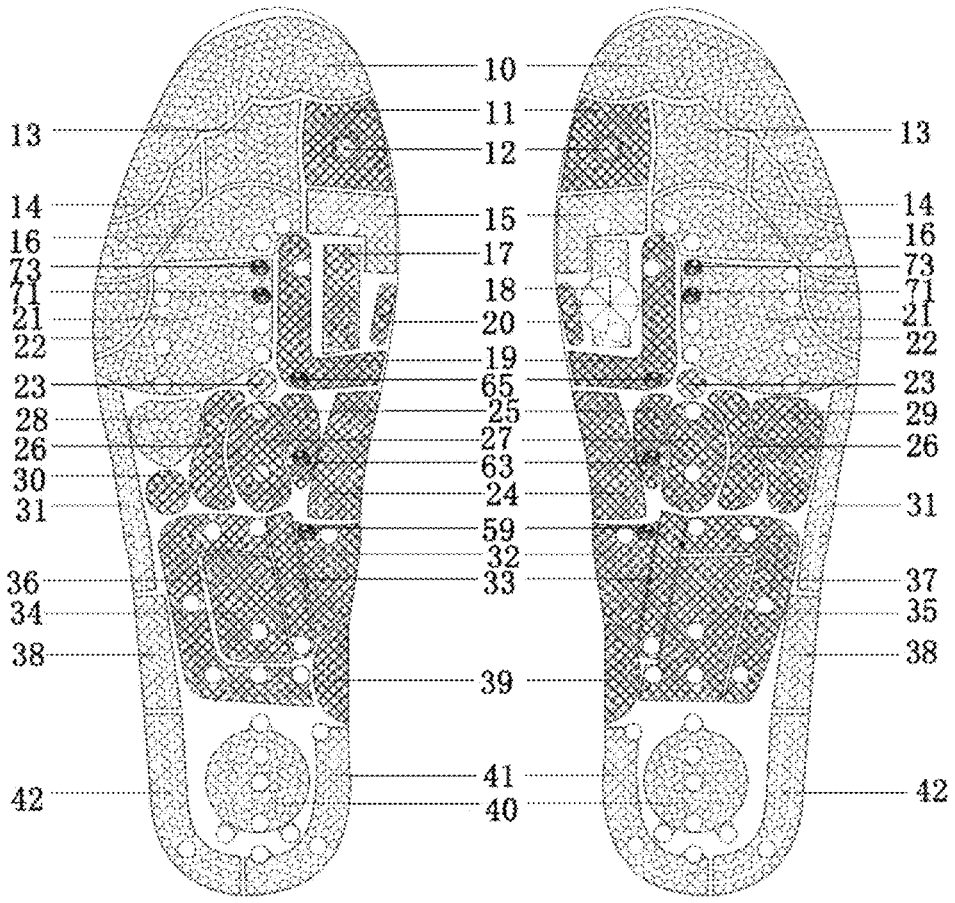
FIG. 8 is a schematic view of a structure of foot massage physiotherapy plates in another embodiment of the utility model.

Combined Foot Massage Physiotherapy Plates corresponding to Symptoms of Constipation As shown in FIG. 8, firstly see about the cross-reference table (Table 1), the applicable table (Table 2) and the procedure table (Table 3). According to prescription principles for selecting basic reflex zones corresponding to symptoms in I, reflex zones corresponding to functions of opening excretory passages and draining viruses and metabolites are selected, dark-color medium-hardness foot reflex zone massage blocks 5 are adopted, and kidney foot reflex zone massage blocks 27, ureter foot reflex zone massage blocks 33 and urinary bladder foot reflex zone massage blocks 39 are selected and installed on bottom plates 1.

According to prescription principles for selecting direct reflex zones corresponding to symptoms in II, reflex zones corresponding to parts at which focuses occur or main symptoms are selected and dark-color medium-hardness foot reflex zone massage blocks 5 are adopted. Since the focuses of constipation occur at rectum and anus, left foot transverse colon, descending colon, rectum and anus foot reflex zone massage block 36 and a right foot cecum, ileocecal valve, ascending colon and transverse colon foot reflex zone massage block 37 are selected and installed on the bottom plates 1.

According to prescription principles for selecting associated reflex zones corresponding to symptoms in III, reflex zones associated with focuses and symptoms are selected and dark-color medium-hardness foot reflex zone massage blocks 5 are adopted. Since constipation is associated with spleen, celiac plexus and small intestine, inner side celiac plexus foot reflex zone massage blocks 25, outer side celiac plexus foot reflex zone massage blocks 26, a left foot spleen foot reflex zone massage block 30, transverse colon and small intestine foot reflex zone massage blocks 32, a left foot small intestine foot reflex zone massage block 34, a right foot small intestine foot reflex zone massage block 35, cerebrum, cerebellum and brainstem foot reflex zone massage blocks 11 associated with constipation, pituitary gland foot reflex zone massage blocks 12, a left foot esophagus and trachea foot reflex zone massage block 17, thyroid gland foot reflex zone massage blocks 19, accessory thyroid gland foot reflex zone massage blocks 20, adrenal gland foot reflex zone massage blocks 23, stomach, pancreas and duodenum foot reflex zone massage blocks 24 and a right foot liver and gallbladder foot reflex zone massage block 29 are selected and installed on the bottom plates 1. For all above-mentioned selected foot reflex zone massage blocks 5 selected, medium-hardness dark-color foot reflex zone massage blocks 5 with stimulation strength are adopted.

According to prescription principles for selecting complementary reflex zones corresponding to symptoms in IV, light-color low-hardness foot reflex zone massage blocks 5 for filling vacant reflex zones on the bottom plates 1 are selected. According to vacant positions, frontal sinus foot reflex zone massage blocks 10, eye foot reflex zone massage blocks 13, ear foot reflex zone massage blocks 14, cervical vertebra and neck foot reflex zone massage blocks 15, trapezius foot reflex zone massage blocks 16, lung and bronchus foot reflex zone massage blocks 21, shoulder foot reflex zone massage blocks 22, a left foot heart foot reflex zone massage block 28, motor center foot reflex zone massage blocks 31, knee foot reflex zone massage blocks 38, genital gland foot reflex zone massage blocks 40, inner tailbone foot reflex zone massage blocks 41 and outer tailbone foot reflex zone massage blocks 42 are sequentially selected and installed on the bottom plates 1. For all above-mentioned selected foot reflex zone massage blocks 5, low-hardness light-color foot reflex zone massage blocks 5 are adopted to increase softness and comfort.

According to prescription principles for selecting foot acupuncture points in V, foot acupuncture point massage posts 9 in the applicable ranges of foot acupuncture points corresponding to parts at which focuses and symptoms are located are selected, and duodenum and dysentery point foot acupuncture point massage posts 59, diarrhea, dysentery and metritis point foot acupuncture point massage posts 63, gastro spasm and gastroenteritis point foot acupuncture point massage posts 65, inner Xiangu point foot acupuncture point massage posts 71 and anus point foot acupuncture point massage posts 73 are selected and installed on massage post bolts 7 on the foot reflex zone massage blocks 5 on the bottom plates 1.

The combined physiotherapy plates corresponding to the symptoms of constipation are placed in casual shoes consistent with foot shapes and sizes, and then the casual shoes are put on for walking half an hour at morning and evening respectively to massage, hit and stimulate foot sole reflex zones and foot acupuncture points to eliminate constipation.

One skilled in the ail shall understand that one of the features or purposes of the utility model is to select foot reflex zone massage blocks and foot acupuncture point massage posts corresponding to symptoms to form various massaging and point hitting physiotherapy plates with different functions according to different demands of users for health, different parts of bodies to be subjected to healthcare and different symptoms of diseases to be treated by using the foot sole massaging and point hitting physiotherapy plates with self-selected foot reflex zones and foot acupuncture points combined corresponding to symptoms provided by the utility model, so as to place the physiotherapy plates in various casual shoes with different sizes for waking in use.

Under the effect of natural pressure produced by human bodies during walking, the foot reflex zones and foot acupuncture points are massaged, hit and stimulated, the natural healing capacity and self-repair function of the human bodies are initiated, the natural potential of the human bodies is deployed, the effects of oriented body healthcare and symptom-based rehabilitation from diseases are realized, and thus the healthcare and rehabilitation demands of people in different health conditions are satisfied. Each of the foot reflex zone massage blocks and each of foot acupuncture point massage posts are selected, combined and installed to form various massaging and point hitting physiotherapy plates with different functions and foot reflex zones and foot acupuncture points combined corresponding to symptoms in accordance with the cross-reference table (Table 1), the applicable table (Table 2) and the procedure table (Table 3) according to different parts of users' bodies to be subjected to healthcare and different demands for treating and rehabilitating from symptoms of different diseases, the foot sole reflex zones and foot acupuncture points are simultaneously massaged and stimulated, the foot holographic reflexology in western medicine and the foot acupuncture point massage therapy in the eastern medicine are fused together, and the dual healthcare rehabilitation effects of correspondingly massaging and stimulating foot reflex zones and hitting and massaging foot sole acupuncture points corresponding to symptoms are fully achieved. The combined and installed massaging and point hitting physiotherapy plates with self-selected foot reflex zones and foot acupuncture points combined corresponding to symptoms are placed in casual shoes consistent with foot shapes and sizes, the holographic reflex zones and foot acupuncture points on foot soles are massaged and hit by using the natural pressure produced by the human bodies during walking, the healthcare of the bodies is realized during walking, the rehabilitation from the diseases is realized during walking, a set of simple-to-operate, safe, reliable, convenient and effective self-diagnosis and treatment healthcare rehabilitation tools is provided for each user, and a professional healthcare doctor, a multi-discipline home clinic and a carried-on rehabilitation hospital are provided for each person with a walking capability.

The Above-mentioned embodiments are just preferred embodiments of the utility model and are not used for limiting the utility model. Any modifications, equivalent substitutions, simple improvements and the like made based on the substantive contents of the utility model shall be included in the protection range of the utility model.

The invention claimed is:

1. A pair of foot massage physiotherapy plates, comprising a pair of bottom plates, a plurality of foot reflex zone massage blocks and a plurality of foot acupuncture point massage posts; wherein the plurality of foot reflex zone massage blocks are connected with the pair of bottom plates through a plurality of massage block bolts and the plurality of foot acupuncture point massage posts are connected with the plurality of foot reflex zone massage blocks through a plurality of massage post bolts; a plurality of massage bulges are arranged on a plurality of front surfaces of the plurality of foot reflex zone massage blocks.

2. The foot massage physiotherapy plates according to claim 1, wherein heights of the plurality of foot acupuncture point massage posts and the plurality of massage bulges are respectively adaptive to human body foot arches.

3. The foot massage physiotherapy plates according to claim 1, wherein the plurality of massage bulges are inclined with respect to the bottom plates, and an inclination angle of the plurality of massage bulges relative to the bottom plates is 60-90 degrees.

4. The foot massage physiotherapy plates according to claim 1, wherein the plurality of foot reflex zone massage blocks comprise a plurality of first foot reflex zone massage blocks and a plurality of second foot reflex zone massage blocks with the same size and shape; a hardness of the plurality of first foot reflex zone massage blocks is higher than a hardness of the plurality of second foot reflex zone massage blocks, and a hardness of the plurality of foot acupuncture point massage posts is higher than the hardness of the plurality of first foot reflex zone massage blocks.

5. The foot massage physiotherapy plates according to claim 1, wherein a plurality of first massage block bolt insertion holes are formed in back surfaces of the plurality of foot reflex zone massage blocks, a plurality of second block bolt insertion holes are formed in front surfaces of the pair of bottom plates, one end of the each massage block bolt is connected with a corresponding first massage block bolt insertion hole and the other end is connected with a corresponding second massage block bolt insertion hole.

6. The foot massage physiotherapy plates according to claim 1, wherein a plurality of first massage post bolt insertion holes are formed in the front surfaces of the plurality of foot reflex zone massage blocks, a plurality of second massage post bolt insertion holes are formed in back surfaces of the plurality of foot acupuncture point massage posts, one end of the each massage post bolt is connected with the corresponding first massage post bolt insertion hole and the other end is connected with the corresponding second massage post bolt insertion hole.

7. The foot massage physiotherapy plates according to claim 1, wherein the plurality of foot reflex zone massage blocks include a plurality of frontal sinus foot reflex zone massage blocks, a plurality of cerebrum, cerebellum and brainstem foot reflex zone massage blocks, a plurality of pituitary gland foot reflex zone massage blocks, a plurality of eye foot reflex zone massage blocks, a plurality of ear foot reflex zone massage blocks, a plurality of cervical vertebra and neck foot reflex zone massage blocks, a plurality of trapezius foot reflex zone massage blocks, a left foot esophagus and trachea foot reflex zone massage block, a right foot pressure reducing point foot reflex zone massage block, a plurality of thyroid gland foot reflex zone massage blocks, a plurality of accessory thyroid gland foot reflex zone massage blocks, a plurality of lung and bronchus foot reflex zone massage blocks, a plurality of shoulder foot reflex zone massage blocks, a plurality of adrenal gland foot reflex zone massage blocks, a plurality of stomach, pancreas and duodenum foot reflex zone massage blocks, a plurality of inner side celiac plexus foot reflex zone massage blocks, a plurality of outer side celiac plexus foot reflex zone massage blocks, a plurality of kidney foot reflex zone massage blocks, a left foot heart foot reflex zone massage block, a right foot liver and gallbladder foot reflex zone massage block, a left foot spleen foot reflex zone massage block, motor center foot reflex zone massage blocks, a plurality of transverse colon and small intestine foot reflex zone massage blocks, a plurality of ureter foot reflex zone massage blocks, a left foot small intestine foot reflex zone massage block, a right foot small intestine foot reflex zone massage block, a left foot transverse colon, descending colon, rectum and anus foot reflex zone massage block, a right foot cecum, ileocecal valve, ascending colon and transverse colon foot reflex zone massage block, a plurality of knee foot reflex zone massage blocks, a plurality of urinary bladder foot reflex zone massage blocks, a plurality of genital gland foot reflex zone massage blocks, a plurality of inner tailbone foot reflex zone massage blocks and a plurality of outer tailbone foot reflex zone massage blocks corresponding to human body foot reflex zones one to one.

8. The foot massage physiotherapy plates according to claim 1, wherein the plurality of foot acupuncture point massage posts include a plurality of scalp point foot acupuncture point massage posts, a plurality of inner side ear point foot acupuncture point massage posts, a plurality of outer side ear point foot acupuncture point massage posts, a plurality of inner side eye point foot acupuncture point massage posts, a plurality of outer side eye point foot acupuncture point massage posts, a plurality of nose point foot acupuncture point massage posts, a plurality of mouth point foot acupuncture point massage posts, a plurality of throat point foot acupuncture point massage posts, a plurality of regeneration point foot acupuncture point massage posts, a plurality of trigeminal nerve point foot acupuncture point massage posts, a plurality of heart point foot acupuncture point massage posts, a plurality of chest point foot acupuncture point massage posts, a plurality of third cancer root point foot acupuncture point massage posts, a plurality of insomnia point foot acupuncture point massage posts, a plurality of sciatic nerve, vermiform appendix and chest point foot acupuncture point massage posts, a plurality of first cancer root point foot acupuncture point massage posts, a plurality of duodenum and dysentery point foot acupuncture point massage posts, a plurality of asthma and cerebrum point foot acupuncture point massage posts, a plurality of neurasthenia and neurosis point foot acupuncture point massage posts, a plurality of sole center point foot acupuncture point massage posts, a plurality of diarrhea, dysentery and metritis point foot acupuncture point massage posts, a plurality of Yongquan point foot acupuncture point massage posts, a plurality of gastro spasm and gastroenteritis point foot acupuncture point massage posts, a plurality of shoulder and urticaria point foot acupuncture point massage posts, a plurality of urinary bladder point foot acupuncture point massage posts, a plurality of inner Linqi point foot acupuncture point massage posts, a plurality of second cancer root point foot acupuncture point massage posts, a plurality of genital point foot acupuncture point massage posts, a plurality of inner Xiangu point foot acupuncture point massage posts, a plurality of Yadian point foot acupuncture point massage posts, a plurality of anus point foot acupuncture point massage posts, a plurality of inner Xiaxi point foot acupuncture point massage posts, a plurality of inner Neiting point foot acupuncture point massage posts, a plurality of Niaodian point foot acupuncture point massage posts, a plurality of inner Taichong point foot acupuncture point massage posts, a plurality of thumbprint point foot acupuncture point massage posts and a plurality of Duyin point foot acupuncture point massage posts corresponding to human body foot acupuncture points one to one.

* * * * *